US005606854A

United States Patent [19]

Hoffmann

[11] Patent Number: 5,606,854

[45] Date of Patent: Mar. 4, 1997

[54] EXHAUST FILTER

[75] Inventor: David J. Hoffmann, Rochester, N.Y.

[73] Assignee: Air Filter Plus Inc., Rochester, N.Y.

[21] Appl. No.: 425,914

[22] Filed: Apr. 20, 1995

[51] Int. Cl.[6] ..... F01N 3/02

[52] U.S. Cl. ..... 60/274; 55/463; 55/510; 55/DIG. 30; 60/311

[58] Field of Search ..... 60/311, 274, 324; 55/463, 429, 476, 498, 510, DIG. 30; 181/252, 258, 222, 231, 243, 256, 267, 271, 281; 96/152

[56] References Cited

U.S. PATENT DOCUMENTS

| | | | |
|---|---|---|---|
| 145,596 | 12/1873 | Seigh | 55/308 |
| 162,498 | 4/1875 | Roberts | 55/308 |
| 1,126,692 | 2/1915 | Blanchette | 55/328 |
| 1,532,730 | 4/1925 | Chalupa et al. | 55/418 |
| 2,012,962 | 9/1935 | Hagar | 55/228 |
| 2,185,584 | 1/1940 | Boyce | 55/517 |
| 2,336,430 | 12/1943 | Wery | 55/463 |
| 3,016,108 | 1/1962 | Myddelton | 96/152 |
| 3,190,058 | 6/1965 | Farr et al. | 55/498 |
| 3,593,499 | 7/1971 | Kile | 96/138 |
| 3,712,030 | 1/1973 | Priest | 60/311 |
| 3,857,688 | 12/1974 | Wisnewski | 60/311 |
| 3,957,133 | 5/1976 | Johnson | 181/267 |
| 4,372,111 | 2/1983 | Virk et al. | 60/274 |
| 4,393,652 | 7/1983 | Munro | 60/295 |
| 4,419,113 | 12/1983 | Smith | 55/484 |
| 4,516,994 | 5/1985 | Kocher | 55/498 |
| 4,645,521 | 2/1987 | Freesh | 60/311 |
| 4,686,827 | 8/1987 | Wade et al. | 60/286 |
| 4,706,454 | 11/1987 | Smith, Jr. | 60/274 |
| 4,728,503 | 3/1988 | Iida et al. | 422/169 |
| 4,969,328 | 11/1990 | Kammel | 60/275 |
| 5,097,665 | 3/1992 | Kammel | 60/275 |
| 5,246,472 | 9/1993 | Herman et al. | 60/311 |

FOREIGN PATENT DOCUMENTS

| | | |
|---|---|---|
| 888823 | 2/1962 | United Kingdom . |
| 2078132 | 1/1982 | United Kingdom . |

*Primary Examiner*—Leonard E. Heyman
*Attorney, Agent, or Firm*—Eugene Stephens & Associates

[57] ABSTRACT

An exhaust filter (10) removes pollutants from exhaust emitted by an internal combustion engine without producing substantial back pressure on the engine. The exhaust filter (10) is assembled from a frame (16), a mounting sleeve (14), and a replaceable filter cartridge (12). A series of baffles (40, 42, 44, 46, 48, and 50) are located along an exhaust passageway (84) within the cartridge (12) for diverting a first portion (88) of a flow of exhaust (80) through a filter media (78). An outlet (86) passes a second portion (90) of the flow of exhaust (80) from the exhaust filter (10) independently of the filter media (78).

43 Claims, 5 Drawing Sheets

EXHAUST FILTER

TECHNICAL FIELD

The invention relates to the field of environmental protection and, in particular, to filtering pollutants from exhaust such as emitted from internal combustion engines.

BACKGROUND

The exhaust of internal combustion engines is known to contain a number of harmful combustion by-products including carbon monoxide, nitrogen oxides, and unburned hydrocarbons. Manufacturers of cars and trucks continue to make design improvements that reduce such harmful emissions. However, older model vehicles ordinarily do not benefit from subsequent design improvements and pollute at higher levels. Performance of the emission controls can degrade over time, adding to the pollution problems of older vehicles.

One solution to the pollution problems of older vehicles is to retrofit their exhaust systems with filters that remove harmful components of the exhaust. The exhaust filters can be used to either supplement or replace the original emission controls.

U.S. Pat. No. 1,532,730 to Chalupa et al. discloses an early example of an exhaust filter attached to an outlet of a muffler. A conical baffle aligned with the muffler outlet disperses a flow of exhaust through a series of strainers for arresting dust and smoke particles. However, the strainers have little effect on the noxious gasses in the exhaust and could create undesirable back pressure on the engine if clogged by the particulate emissions.

U.S. Pat. No. 3,593,499 to Kile also appends an exhaust filter to a muffler. The filter includes a fibrous disc for removing particles and a replaceable canister filled with charcoal chunks for removing noxious gasses. A fan is positioned in line with the filter to compensate for back pressures produced by the filters. However, the requirement for an independent power source to operate the filter adds undue cost to the design and complicates servicing of exhaust systems.

U.S. Pat. No. 4,706,454 to Smith, Jr. discloses an in-line exhaust filter having primary and secondary passageways. The primary passageway is a conduit interconnecting an inlet and an outlet. The secondary passageway by-passes a portion of the primary passageway for circulating exhaust through one or more annular filter cartridges surrounding the conduit. The exhaust is diverted to and from the secondary passageway by baffle spinners located along the conduit. Although passage of exhaust through the central passageway would reduce back pressures, large portions of the exhaust are expected to remain unfiltered because a pressure drop across the filter would impair return of the exhaust to the conduit.

SUMMARY OF INVENTION

My invention provides for filtering pollutants from exhaust in a convenient and cost-effective manner. The new filtration accommodates high flow rates, such as emitted by internal combustion engines, without producing back pressures that impair engine performance.

One version of my invention includes a canister having porous inner and outer walls that are spaced apart for holding a filter media, such as activated charcoal. The inner wall surrounds an exhaust passageway within the canister.

An inlet admits a flow of exhaust into the exhaust passageway, and a series of baffles located along the passageway divert a first portion of the flow of exhaust through the filter media. An outlet passes a second portion of the flow of exhaust from the filter independently of the filter media. The outer wall of the canister passes the first portion of the flow of exhaust from the filter independently of the outlet.

Preferably, at least 80 percent of the flow of exhaust passes through the filter media. However, should the filtered pollutants partially clog the filter media, additional flow can exit the filter through the outlet to prevent the accumulation of undesirable back pressure.

The baffles are preferably bell-shaped with deflection surfaces that flare obliquely to the direction of the flow of exhaust from the inlet to the outlet. Also, the baffles preferably progress in size from small to large along the direction of the exhaust flow. However, the baffles are limited in size with respect to the inner wall of the canister to deflect only the first portion of the exhaust flow, thereby allowing the second portion of the exhaust flow to pass through the outlet.

Another version of my invention is assembled with a frame having first and second ends and a series of baffles supported between the two ends. The first end connects the frame to an exhaust system. A cartridge, which is removably mounted on the frame, has porous inner and outer walls separated by a space containing filter media. The inner wall forms a passageway for channeling exhaust between the two ends. The baffles are aligned along the passageway for deflecting a first portion of the exhaust through the filter media. The outer wall has a substantial area exposed to ambient air for passing the first portion of the exhaust to the ambient air without developing significant back pressure on the exhaust system.

Preferably, a sleeve is attached to the first end of the frame for connecting the frame to an open end of an exhaust pipe. A fastener is preferably attached to the second end of the frame for securing the cartridge to the frame. An inlet is preferably formed through the first end of the frame, and an outlet is preferably formed through the second end of the frame. The outlet passes a second portion of the exhaust to the ambient air independently of the filter media.

A rod extends between the two ends of the frame for supporting the baffles, which progressively increase in size to evenly distribute the exhaust through the filter media. The rod defines an axis of the filter along the passageway between the two ends. The baffles deflect the first portion of the exhaust radially of the axis for passing the first portion of the exhaust through the outer wall of the cartridge. The second portion of the exhaust is passed through the outlet along the axis.

The outer wall is preferably a screen having a mesh size that is small enough to contain the filter media but large enough to permit emissions coalesced within the filter media to be discharged through the outer wall. A shield, which partially surrounds the outer wall, can be used to deflect heat and exhaust away from a vehicle body or to protect the filter from road hazards.

My invention can also be practiced as a method of filtering pollutants from exhaust emitted by an internal combustion engine. A filter is connected to an engine exhaust system. The exhaust is directed through an inlet into a passageway of the filter. A first portion of the exhaust within the passageway is deflected through a filter media contained within an outer wall of the filter. A second portion of the exhaust is passed from the filter through an outlet independently of the filter media. The first portion of the exhaust is passed from the filter through the outer wall independently of the outlet.

Preferably, the outer wall is largely exposed to ambient air so the first portion of the exhaust includes at least 80 percent of the exhaust directed through the inlet. The second portion of the exhaust preferably comprises no more than 20 percent of the exhaust that is directed through the inlet. The filter is preferably assembled from a frame attached to the exhaust and a replaceable filter cartridge mounted on the frame. After use for a period of time required to at least partially saturate the filter media, the cartridge can be replaced or refurbished.

My new filter and method, of filtration can be used to either supplement or replace other emission controls. In fact, my invention is expected to be both cheaper and more effective than repairing or refurbishing some of the original emission controls on cars or trucks.

DRAWINGS

DETAILED DESCRIPTION

Figure 1:
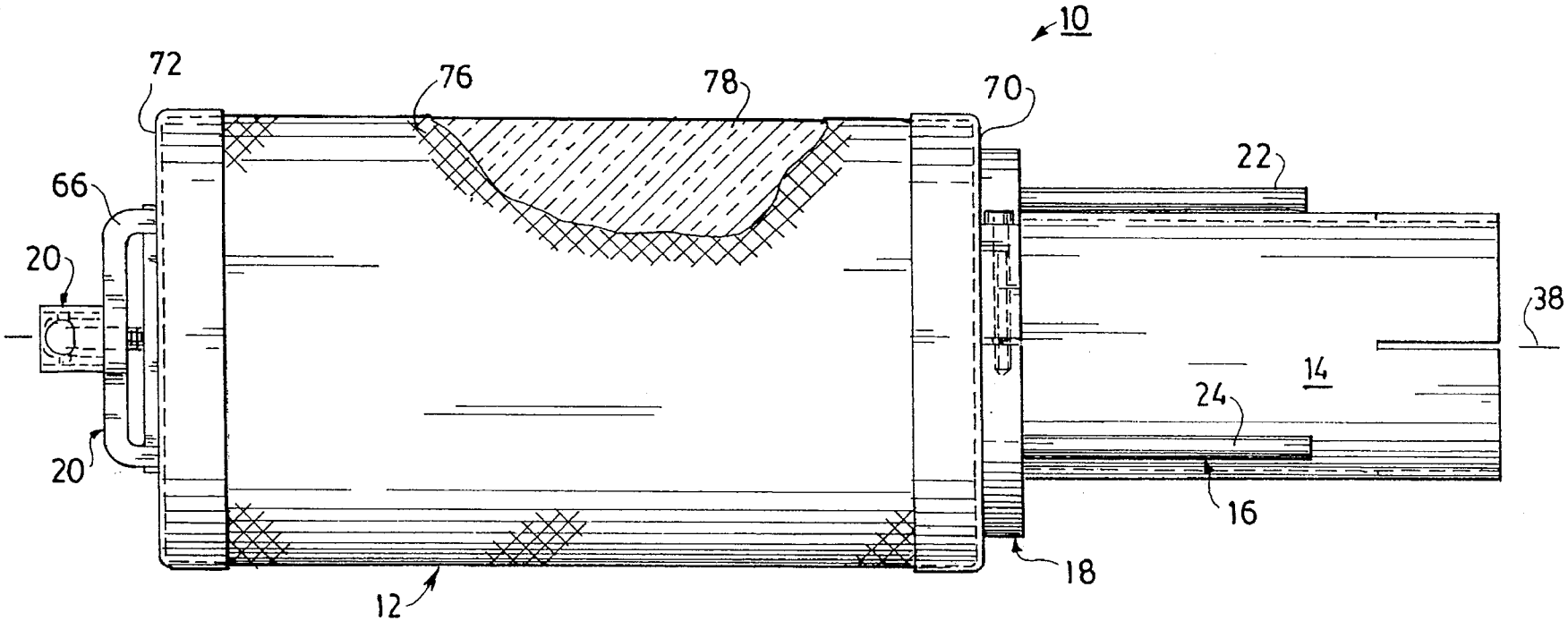
FIG. 1 is a side view of my new exhaust filter showing a mounting sleeve and a filter cartridge.

A preferred embodiment of my invention is an exhaust filter 10 illustrated by the drawing figures. The exhaust filter 10 includes a hollow filter cartridge 12 and a mounting sleeve 14 supported by a frame 16. Clamp 18 secures the mounting sleeve 14 to the frame 16 and provides end support for the filter cartridge 12. Removable fastener 20 secures the filter cartridge to the frame 16.

Figure 2:
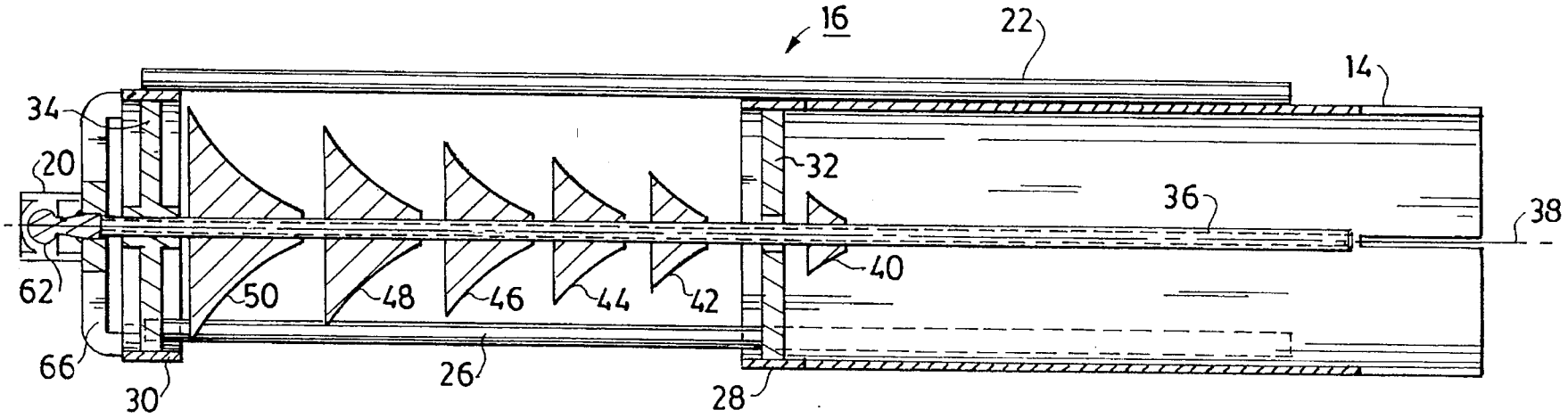
FIG. 2 is a cross-sectional side view of a frame for supporting the mounting sleeve and filter cartridge.
Figure 3:
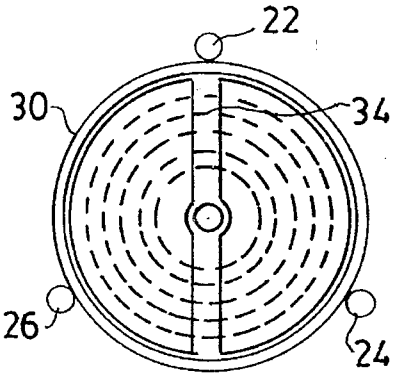
FIG. 3 is an end view of the frame.

The frame, which is best seen in FIGS. 2 and 3, includes three guide rods 22, 24, and 26 attached to the periphery of two support rings 28 and 30. Braces 32 and 34 span the support rings 28 and 30 and support a threaded rod 36 in alignment with a central axis 38. A series of six baffles 40, 42, 44, 46, 48, and 50 are threadably mounted on the threaded rod 36. The baffles, which are substantially bell-shaped, progress in size along the central axis 38 from the smallest 40 to the largest 50.

Figure 4:
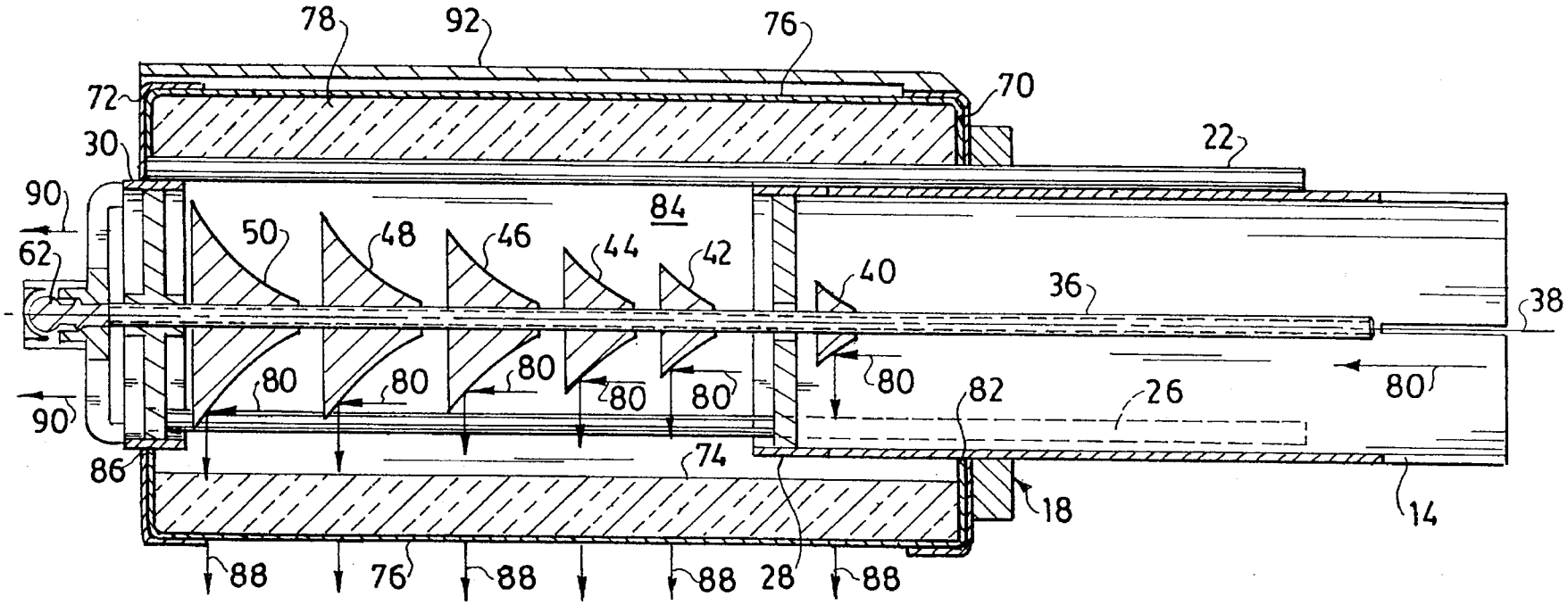
FIG. 4 is a cross-sectional side view of the exhaust filter with a deflection shield attached.
Figure 5:
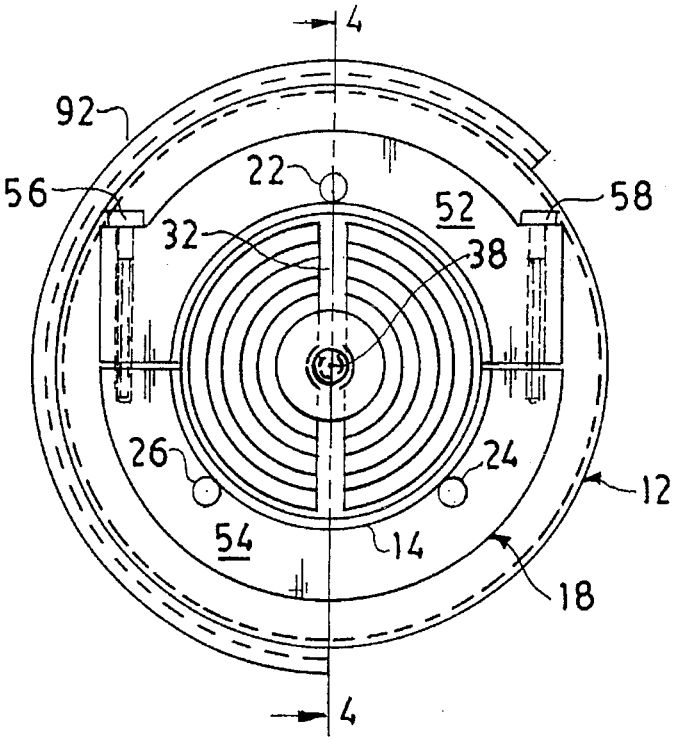
FIG. 5 is an front end view of the exhaust filter.
Figure 6:
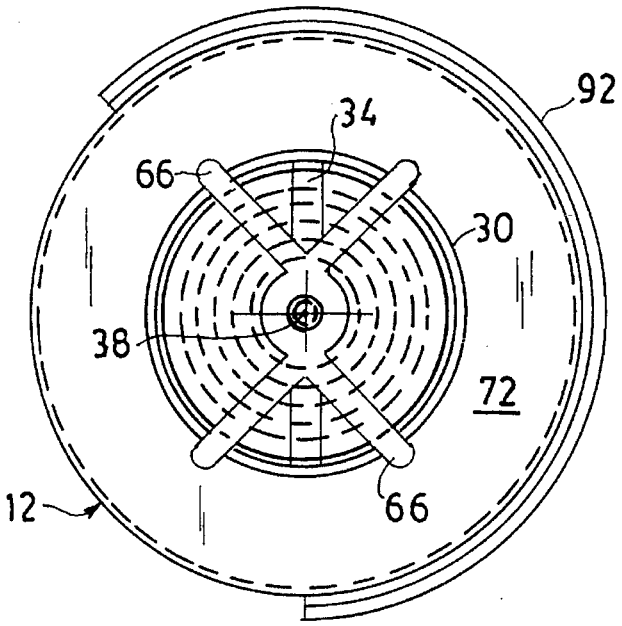
FIG. 6 is a rear end view of the exhaust filter.

The clamp 18, shown best in FIG. 5, includes two halves 52 and 54 that are drawn together by screws 56 and 58. When drawn together as shown also in FIG. 4, the two halves 52 and 54 squeeze the three guide rods 22, 24, and 26 against a peripheral surface of the mounting sleeve 14 for attaching the mounting sleeve 14 to the frame 16. The filter cartridge 12 is slidably mounted on the guide rods 22, 24, and 26 into a position abutting the clamp 18. The threaded rod 36 includes a shaped end 62 for engaging the removable fastener 20 with a twist interlock. The fastener 20, which can be seen also in FIG. 6, has four legs 66 for securing the filter cartridge 12 on the frame 16.

The filter cartridge 12 as shown in FIG. 4 includes front and rear ends 70 and 72 and porous inner and outer walls 74 and 76 that are separated by a space filled with an activated charcoal filter media 78. The inner and outer walls 74 and 76 are preferably made from stainless steel screen having a mesh size small enough to contain the activated charcoal media 78, which is preferably sized at less than one millimeter. However, the mesh is preferably large enough in size to permit hydrocarbon solids filtered by the activated charcoal to be discharged from the filter. For example, vibrations accompanying use of the exhaust filter 10 on an automobile exhaust system are expected to loosen some of the filtered solids, and their discharge is expected to extend the service life of the filter media 78.

FIG. 4 also shows flow paths through the filter 10 taken by exhaust 80, which is produced by an internal combustion engine (not shown). The exhaust 80 enters the filter cartridge 12 from the sleeve 14 through an inlet 82 formed through the front end 70 of the filter cartridge. The inner wall 74 of the cartridge forms a central passageway 84 through the cartridge connecting the inlet 82 with an outlet 86 formed through the rear end 72 of the cartridge. The baffles 40, 42, 44, 46, 48, and 50 progressively deflect first portions 88 of the exhaust 80 radially of the central axis 38 through the inner wall 74, the filter media 78, and the outer wall 76. However, sufficient clearance remains between the largest baffle 50 and the inner wall 74 so that second portions 90 of the exhaust pass through the outlet 86 on a path that extends along the central axis 38.

The baffles 40, 42, 44, 46, 48, and 50 are each flared to the direction of the flow of the exhaust 80 from the inlet 82 to the outlet 86 and are positioned along the rod 36 and progressively sized to distribute the first portions 88 of the exhaust 80 evenly through the filter media 78. The porous outer wall 76 has a circumference that is exposed to ambient air to provide largely unrestricted passage of the first portions 88 of the exhaust from the exhaust filter 10 independently of the outlet 86. Preferably, at least 80 percent of the exhaust 80 passes through the filter media 78 and the outer wall 76.

The remaining second portion 90 of the exhaust 80 passes through the outlet 86 independently of the filter media 78 and the outer wall 76. Preferably, no more than 20 percent of the exhaust 80 passes through the outlet 86 so that as much as possible of the exhaust 80 is filtered. However, the separate passageway through the outlet 86 assures that no substantial back pressure is generated by restrictions in the filter media 78 which could impair operation of the engine. A whistle (not shown) could be connected to the outlet 86 to emit a sound at a predetermined flow rate through the outlet 86 indicating a need to replace the filter cartridge 12.

Figure 7:
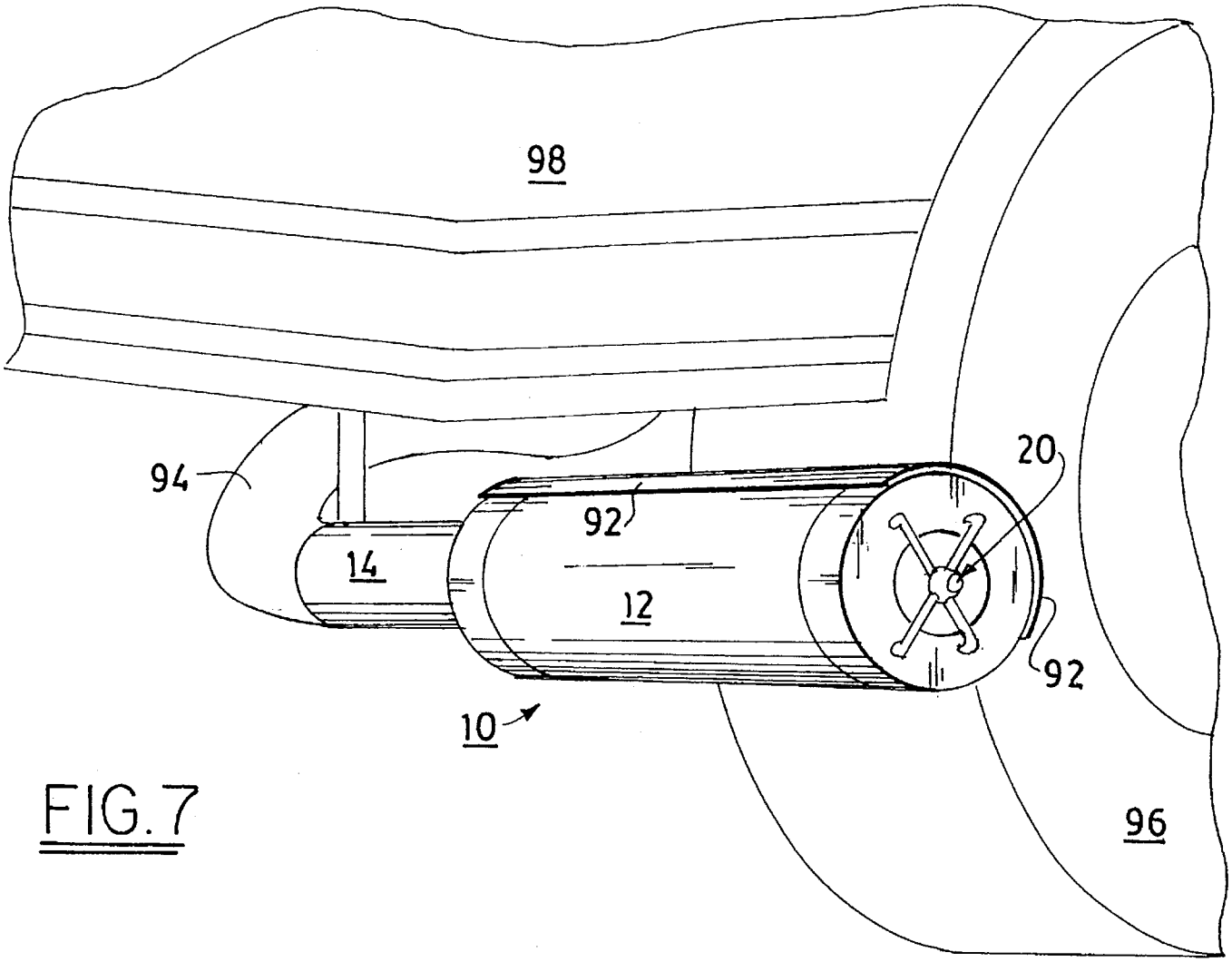
FIG. 7 is a perspective view of the exhaust filter mounted on a tail pipe of a vehicle.

A deflection shield 92 attached (e.g., welded) to the frame 16 surrounds a limited portion of the circumference of the outer wall 76. The shield 92 can be adjusted around the central axis 38 to perform a number of functions including deflecting heat and exhaust from the exhaust filter 10 and protecting the filter 10 from road debris. For example, FIG. 7 shows my exhaust filter 10 attached to a tail pipe 94 that protrudes behind a wheel 96 of a vehicle body 98. The shield 92 deflects heat and exhaust passing through the outer wall 76 along the central axis 38 and away from the vehicle body 98. In addition, the shield 92 protects the outer wall 76 from road debris thrown by the wheel 96.

The mounting sleeve 14 is assembled together with the frame 16 and the shield 92 and is slid over the end of the tail pipe 94. The clamp 18 secures the assembly to the tail pipe 94. The filter cartridge 12 is slid over the guide rods 22, 24, and 26 into position against the clamp 18. The fastener 20 is slid over the shaped end 62 of the threaded rod 36 and is rotated to lock the filter cartridge 12 on the frame 16. Preferably, both the clamp 18 and the fastener 20 are secured with special tools to prevent unauthorized removal of the filter 10 or the filter cartridge 12.

During use, the mounting sleeve 14 directs the exhaust 80 through the inlet 82 into the central passageway 84 of the filter cartridge 12. The baffles 40, 42, 44, 46, 48, and 50 deflect the first portion 88 of the exhaust 80 through the filter media 78 to the ambient air surrounding the outer wall 76. A second portion 90 of the exhaust 80 is passed through the outlet 86 to the ambient air independently of the filter media 78. The shield 92 deflects some of the exhaust 80 passing through the outer wall 76 away from the vehicle body 98 and protects the outer wall 76 from damage by road hazards.

Ordinarily, only a small percentage of the exhaust 80 is passed through the outlet 86 to provide maximum filtering efficiency. However, as the filter media 78 becomes clogged from use, a larger percentage of the exhaust 80 is passed through the outlet to prevent the development of back pressure on the engine. A whistle or other signaling device can be used to indicate the need to replace the filter cartridge 12.

The fastener 20 is unlocked (preferably with the required special tool) to remove the filter cartridge 12 from the frame 16 and replace it with another. Alternatively, the filter media 78 could be refurbished or replaced, and the same filter cartridge 12 could be remounted on the frame 16. The fastener 20 locks the replaced or remounted filter cartridge on the frame 16.

A test of my exhaust filter was made on a 1983 Chevrolet Malibu Station Wagon having a 3.1 liter V6 engine at approximately 102,000 miles. A Sun Interrogator II engine analyzer was used to measure hydrocarbon content in units of parts per million (PPM). Before my filter was installed, hydrocarbons were recorded at 618 PPM with the engine idling and at 250 PPM with the engine rotating at 3000 engine revolutions per minute (rpm). After installation of my filter, measurements were taken at two locations—at the outlet and adjacent to the outer wall. The measurements at the outlet recorded hydrocarbon levels of 126–130 PPM at idle and 69–73 PPM at 3000 rpm. Adjacent to the outer wall, the measurements recorded levels of 58 PPM at idle and 49–62 PPM at 3000 rpm.

My exhaust filter can also be configured in a variety of different ways to achieve similar overall results. For example, one or more parts or functions of the frame could be incorporated into the cartridge. Instead of replacing the cartridge, a canister incorporating the functions of both the cartridge and the frame could be replaced. Other changes could be made for replacing just the filter media. The mounting sleeve, frame, cartridge, and shield can be made from stainless steel; but substitutes such as aluminum or thermal plastics could also be used.

My exhaust filter could also be mounted in different locations within an exhaust system; and the shape, location, and mounting of the baffles could also be changed. For example, the baffles could be molded as a part of a unitary structure that is attached to the inner wall of the filter cartridge. Also, the baffles could be similarly sized but have a progression of smaller openings in the direction of the exhaust flow. A safety valve could also be incorporated into the outlet to prevent discharge of exhaust through the outlet until a predetermined maximum back pressure is developed.

I claim:

1. An exhaust filter for removing pollutants from a flow of exhaust comprising:

a canister having porous inner and outer walls that are spaced apart for holding a filter media;

said inner wall surrounding an exhaust passageway within said canister;

an inlet for admitting the flow of exhaust into said exhaust passageway;

a series of baffles located along said exhaust passageway for diverting a first portion of the flow of exhaust through the filter media;

an outlet for passing a second portion of the flow of exhaust from the filter independently of the filter media; and said outer wall providing for passing the first portion of the flow of exhaust from the filter independently of said outlet.

2. The filter of claim 1 in which said filter also includes two ends that enclose said inner and outer walls of the canister.

3. The filter of claim 2 in which said inlet is formed in one of said two ends and said outlet is formed in the other of said two ends.

4. The filter of claim 1 in which said baffles are limited in size with respect to said inner wall of the canister to deflect only the first portion of the exhaust flow, thereby allowing the second portion of the exhaust flow to pass through said outlet.

5. The filter of claim 4 in which said baffles progress in size from small to large in the direction of the exhaust flow from the inlet to the outlet.

6. The filter of claim 5 in which sufficient clearance remains between a largest of said baffles and said inner wall so that the second portion the exhaust flow passes through said outlet.

7. The filter of claim 6 in which said baffles are at least partially bell-shaped having deflection surfaces that flare obliquely to the direction of the exhaust flow from the inlet to the outlet.

8. The filter of claim 2 in which a rod extending between said two ends supports said baffles.

9. The filter of claim 8 in which said baffles are centered with respect to an axis of said rod.

10. The filter of claim 8 in which said two ends and said rod are part of a frame for supporting said canister.

11. The filter of claim 10 in which a shield is attached to said frame for deflecting the flow of exhaust passing through said outer wall.

12. The filter of claim 11 in which said outer wall forms a circumference of said canister and said shield surrounds only a portion of said circumference.

13. The filter of claim 1 in which said outlet is sized so that no substantial back pressure is developed in resistance to the flow of exhaust.

14. The filter of claim 13 in which said baffles are shaped and spaced apart to distribute the first portion of the flow of exhaust evenly through the filter media.

15. The filter of claim 14 in which the first portion of the flow of exhaust includes at least 80 percent of a total flow of exhaust through both the filter media and the outlet.

16. The filter of claim 1 in which said outer wall is exposed to ambient air.

17. The filter of claim 16 in which said outer wall is a screen.

18. A filter for use in an exhaust system of an internal combustion engine comprising:

a frame having two ends;

a first of said ends adapted for connection to the exhaust system;

a series of baffles supported by said frame between said two ends;

a cartridge removably mounted on said frame and having porous inner and outer walls separated by a space containing filter media;

said inner wall forming a passageway for channeling exhaust between said two ends;

said baffles being aligned along said passageway for deflecting a first portion of the exhaust through said filter media for removing pollutants from the exhaust; and said outer wall having a substantial area exposed to ambient air for passing the first portion of the exhaust to the ambient air without developing significant back pressure on the internal combustion engine.

19. The filter of claim 18 in which said cartridge includes an outlet for passing a second portion of the exhaust to the ambient air independently of said filter media to further limit the development of back pressure.

20. The filter of claim 19 in which said outlet is formed through a second of said two ends of the frame.

21. The filter of claim 20 in which an inlet is formed through said first end of the frame.

22. The filter of claim 21 in which said first end of the frame is adapted for attachment to an open end of an exhaust pipe.

23. The filter of claim 22 in which a sleeve is attached to said first end of the frame for connecting the filter to an open end of the exhaust pipe.

24. The filter of claim 18 in which a fastener is attached to a second of said two ends of the frame for securing said cartridge to said frame.

25. The filter of claim 18 in which a shield is attached to said frame for deflecting the exhaust passing through said outer wall.

26. The filter of claim 25 in which said outer wall forms a circumference of said cartridge and said shield surrounds only a portion of said circumference.

27. The filter of claim 18 in which said filter media is an activated charcoal for removing hydrocarbons from the exhaust.

28. The filter of claim 27 in which said outer wall is a screen having a mesh size that contains the activated charcoal but permits hydrocarbon solids filtered by the activated charcoal to be discharged from the filter.

29. The filter of claim 28 in which said screen is made from a stainless steel.

30. The filter of claim 18 in which said frame includes a rod extending between said two ends of the frame for supporting said baffles.

31. The filter of claim 30 in which said baffles progressively increase in size to distribute the exhaust through said filter media.

32. The filter of claim 30 in which said rod defines an axis of the filter along said passageway between the two ends of the frame.

33. The filter of claim 32 in which said baffles deflect the first portion of the exhaust radially of said axis for passing the first portion of the exhaust through said filter media.

34. The filter of claim 33 in which said cartridge includes an outlet for passing a second portion of the exhaust to the ambient air along said axis.

35. A method of filtering pollutants from exhaust emitted by an internal combustion engine without producing substantial back pressure on the engine comprising the steps of:

connecting a filter to an exhaust system of the engine;

directing said exhaust through an inlet into a passageway through the filter;

deflecting a first portion of the exhaust through a filter media contained within an outer wall of the filter;

passing a second portion of the exhaust from the filter through an outlet independently of the filter media; and passing the first portion of the exhaust from the filter through the outer wall independently of the outlet.

36. The method of claim 35 in which said step of passing the first portion of the exhaust includes exposing the outer wall of the filter to ambient air.

37. The method of claim 35 in which the passageway through the filter includes an axis that extends between the inlet and the outlet.

38. The method of claim 37 in which the first portion of the exhaust is passed from the filter radially of the axis and the second portion of the exhaust is passed from the filter along the axis.

39. The method of claim 38 including a further step of surrounding a section of the outer wall with a shield for deflecting the first portion of the exhaust along the axis.

40. The method of claim 38 in which the first portion of the exhaust comprises at least 80 percent of the exhaust that is directed into the passageway.

41. The method of claim 38 in which the second portion of the exhaust comprises at least 20 percent of the exhaust that is directed into the passageway.

42. The method of claim 35 in which said step of connecting includes connecting a frame to the exhaust system and mounting a filter cartridge on the frame.

43. The method of claim 42 including a further step of removing the filter cartridge from the frame and replacing the filter cartridge with another.

* * * * *